US012017822B2

(12) United States Patent
Mayer et al.

(10) Patent No.: US 12,017,822 B2
(45) Date of Patent: Jun. 25, 2024

(54) CLOSURE CAP FOR CLOSING A CONTAINER

(71) Applicant: ALPLA WERKE ALWIN LEHNER GMBH & CO. KG, Hard (AT)

(72) Inventors: Erwin Mayer, Eisgarn (AT); Franz-Michael Lässer, Lochau (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 146 days.

(21) Appl. No.: 17/438,861

(22) PCT Filed: Mar. 11, 2020

(86) PCT No.: PCT/EP2020/056434

§ 371 (c)(1),
(2) Date: Sep. 13, 2021

(87) PCT Pub. No.: WO2020/182852

PCT Pub. Date: Sep. 17, 2020

(65) Prior Publication Data

US 2022/0153480 A1 May 19, 2022

(30) Foreign Application Priority Data

Mar. 11, 2019 (CH) ..... 288/19
Apr. 16, 2019 (CH) ..... 523/19
(Continued)

(51) Int. Cl.
*B65D 41/04* (2006.01)
*B65D 41/34* (2006.01)
*B65D 55/16* (2006.01)

(52) U.S. Cl.
CPC ..... *B65D 41/0457* (2013.01); *B65D 41/0471* (2013.01); *B65D 41/3428* (2013.01); *B65D 55/16* (2013.01); *B65D 2401/30* (2020.05)

(58) Field of Classification Search
CPC ..... B65D 41/0457; B65D 41/0471; B65D 41/3428; B65D 55/16; B65D 2401/30
See application file for complete search history.

(56) References Cited

U.S. PATENT DOCUMENTS 5,215,204 A * 6/1993 Beck ..... B65D 55/16 215/258
6,474,491 B1 * 11/2002 Benoit-Gonin .... B65D 41/3428 220/263
2020/0115115 A1 * 4/2020 Migas ..... B65D 55/16

FOREIGN PATENT DOCUMENTS

DE 2430775 A1 1/1975
DE 9318243 U1 2/1994
(Continued)

*Primary Examiner* — James N Smalley
(74) *Attorney, Agent, or Firm* — MORRISS O'BRYANT COMPAGNI CANNON, PLLC

(57) ABSTRACT

A closure cap for closing the pouring opening of a container has a cylindrical threaded part with an open rim and an inner thread which can co-operate with an outer thread of a container neck of the container, a security ring which is designed to be held on a projection formed on the container neck, a plurality of security webs which releasably connect the security ring with the open rim, and a first retaining strip having a first and a second end, the first end being securely connected to the open rim of the threaded part and the second end being securely connected to the security ring. The closure cap comprises a second retaining strip having a third and a fourth end, the third end being securely connected to the open rim of the threaded part and the fourth end being securely connected to the security ring.

28 Claims, 8 Drawing Sheets

(30) Foreign Application Priority Data

Figure 1:
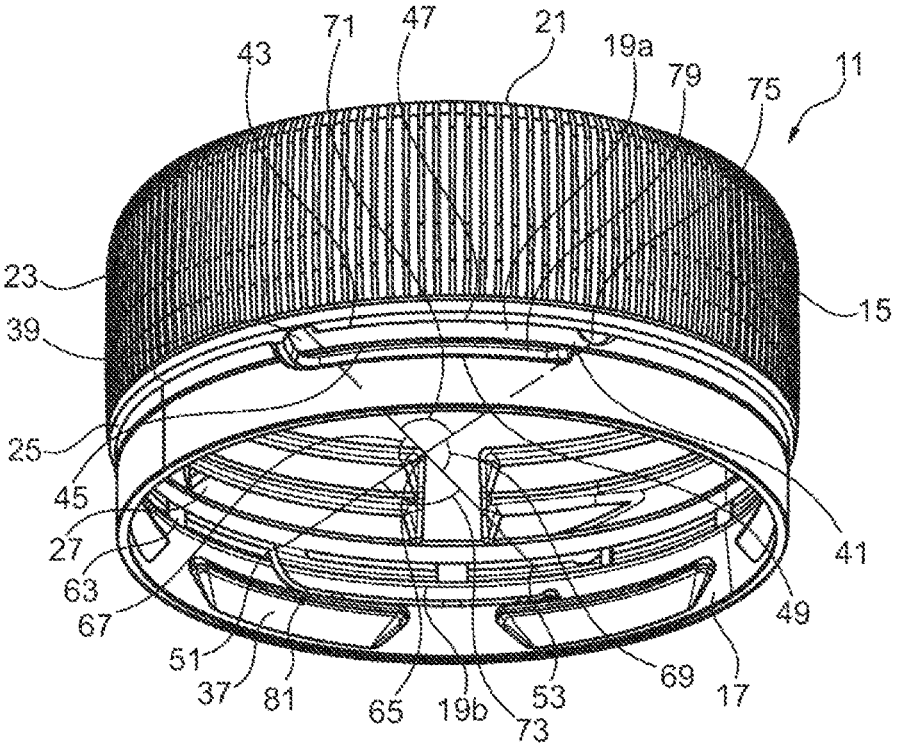

| | | |
|---|---|---|
| Nov. 20, 2019 | (CH) | 1467/19 |
| Dec. 12, 2019 | (CH) | 1599/19 |
| Dec. 23, 2019 | (CH) | 1695/19 |

(56) References Cited

FOREIGN PATENT DOCUMENTS

| | | | | |
|---|---|---|---|---|
| DE | 102018130541 | A1 * | 7/2020 | B65D 41/3428 |
| FR | 2785264 | A1 | 5/2000 | |
| WO | 2009002057 | A2 | 12/2008 | |
| WO | 2014200165 | A1 | 12/2014 | |

* cited by examiner

CLOSURE CAP FOR CLOSING A CONTAINER

CROSS-REFERENCE TO RELATED APPLICATIONS

This application is a national phase entry under 37 U.S.C § 371 of PCT/EP2020/056434 filed Mar. 11, 2020, which claims priority to Swiss Patent Application No. 00288/19 filed Mar. 11, 2019, Swiss Patent Application No. 00523/19 filed Apr. 16, 2019, Swiss Patent Application No. 01467/19 filed Nov. 20, 2019, Swiss Patent Application No. 01599/19 filed Dec. 12, 2019, and Swiss Patent Application No. 01695/19 filed Dec. 23, 2019, the entirety of each of which is incorporated by this reference.

FIELD OF THE INVENTION

The invention relates to a closure cap for closing a container and to a container having such a closure cap.

PRIOR ART

Closure caps which are captively held on the container and close the pouring opening thereof are known from the prior art in the field of plastic closure caps having a security band. The holding function is also important, since legal regulations are to be expected under which closures of beverage bottles must be connected captively to the beverage bottle even when in the open state.

DE 24 30 775 A1 discloses such a captive closure cap. The cap consists of a screwable upper part and a lower collar that engages behind a bead on the container mouth. The upper threaded part of the cap is connected to the lower collar via an easily tearable cylindrical tongue. This tongue extends over the entire circumference and is connected to the upper part or the lower collar via an upper and a lower row of connecting teeth. This cylindrical tongue is interrupted at one point of the circumference so that it gains two ends, one of which is securely connected to the screwable cap part and the other is securely connected to the lower collar. The connecting teeth of the upper and lower rows tear in an undefined manner when the cap is being unscrewed. As a result, after unscrewing, teeth on the upper and the lower rows are partially torn and partially still connected to the cap part and the lower collar. When liquid is poured out, the cap dangling on the container can prove to be disruptive, since it can protrude into the liquid flow and causes liquid to spill.

AIM OF THE INVENTION

It is therefore an aim of the invention to prevent the disadvantages described above by creating a captive closure cap that is not obstructive during any use of the container to be closed.

SUMMARY OF THE INVENTION

The posed aim is achieved in a closure cap for closing a container and a container having such a closure cap according to the independent claims. Developments and/or advantageous alternative embodiments are the subject matter of the dependent claims.

The invention provides a second retaining step having a third and a fourth end and a third and fourth rim, wherein the third end is securely connected to the open rim of the threaded part, the fourth end is securely connected to the security ring, the third rim is releasably connected to the open rim of the threaded part by at least one, third, predetermined breaking web, and the fourth rim is releasably connected to the security ring by at least one, fourth, predetermined breaking web, wherein the first and third ends enclose a first opening angle of at least 110 degrees and at most 170 degrees, or at least 117 and at most 135 degrees, with respect to the center point of the closure cap as apex, and the second and fourth ends enclose a second opening angle of at least 110 degrees and at most 170 degrees, or at least 117 and at most 135 degrees, with respect to the center point of the closure cap as apex. The center point of the closure cap lies in the plane between the open rim and the security ring. By selecting the first and third opening angles, the length of the first and second retaining strips and their position along the security ring can be precisely determined, so that the following functions are fulfilled irrespective of which diameter the closure cap has: The first and second retaining strips have a length which simultaneously enables the threaded part to be unscrewed from the container neck. Subsequently, the length of the retaining strips allows the threaded part to be moved translationally away from the pouring opening and to be moved downwards along the container neck into an open position. By providing two retaining strips, this translational movement is forcibly guided, and the threaded part is forced into an open position. In the open position, the threaded part is captively held on the security ring or the container neck. In the open position, the bottom of the threaded part has the same orientation as in its position when screwed onto the container neck, but translationally offset to the outer wall of the container neck. Furthermore, the first and second retaining strips prevent the threaded part from protruding into the pouring opening when filling material is poured out.

Expediently, the first and second ends enclose a third opening angle of at least 40 degrees and at most 70 degrees, or at least 45 and at most 63 degrees, with respect to the center point of the closure cap as apex. By selecting the third opening angle, the first retaining strip has a defined length, by means of which the functions stated above are made possible together with the second retaining strip.

Expediently, the third and fourth ends enclose a fourth opening angle of at least 40 degrees and at most 70 degrees, or at least 45 and at most 63 degrees, with respect to the center point of the closure cap as apex. By selecting the fourth opening angle, the second retaining strip has a defined length, by means of which the functions stated above are made possible together with the first retaining strip.

Since the first, second, third, and fourth opening angles have a center point of a circle as apex, their angle sum must be 360 degrees.

In a particular embodiment of the invention, the third and fourth opening angles are of equal size, as a result of which the first and second retaining strips are of equal length. The identical length of the first and second retaining strips enables the translational, forcibly-guided movement after the threaded part is unscrewed from the container neck. The retaining strips allow movement into the open position of the threaded part in only one direction. Accordingly, there is only one open position for the threaded part.

The first and second retaining strips may be arranged symmetrically on the security ring with respect to a plane of symmetry that runs through the axis of rotation of the threaded part. The first, second, third, and fourth ends may have equal standard distances from the plane of symmetry. This means that the first and second retaining strips are arranged at an offset of 180 degrees on the security ring. As a result, when the threaded part is unscrewed, the first and second retaining strips can slide in an unimpeded manner along the container neck and be stretched.

In a further embodiment of the invention, the cross-section of the first and second retaining strips is constant along the length of the first or second retaining strip. The retaining strips thereby have constant elastic properties along their length, as a result of which a defined length of the retaining strips can be determined at which the threaded part can be held in its open position on the container in a stable and wobble-free manner. In the open position, the first and second retaining strips are pretensioned. The elastic pretensioning of the retaining strips enables the threaded part to be unscrewed from the container neck several times and screwed onto it again, and to be reliably held several times in the open position. The constant cross-section of the retaining strips along their length prevents the retaining strips from being overly stretched in the open position.

In a further embodiment of the invention, a first or a second narrowing of the cross-section of the first or the second retaining strip is provided at the second or the fourth end, as a result of which the second or the fourth end can act as an articulation. The movement of the first and second retaining strips during the transfer of the threaded part from the closing position into the open position is facilitated or defined in a direction of rotation by this articulation function. It is also conceivable for the first and third ends to have an articulation function so that the first and second retaining strips can be moved like a lever with two pivot points during the movement of the threaded part. For example, the first and third ends can be fastened to the open rim in a bendable manner.

The security webs may be arranged at uniform intervals along the open rim. The security ring is therefore held on the threaded part in a sufficiently stable manner that the closure cap can be pressed onto the container neck. The threaded part can also be unscrewed with uniform force, due to the uniform intervals of the security webs.

The first, second, third, and fourth predetermined breaking webs are, expediently, arranged at uniform intervals along the first and second or third and fourth rims. As a result, the closure cap is sufficiently stable, even in the region of the first and second retaining strips, to be able to be pressed onto the container neck. In addition, the broken predetermined breaking webs and security webs show that the threaded part has already been twisted in relation to the container neck and is no longer originally closed.

In a further embodiment of the invention, the position of the security ring in relation to the annular projection of the container neck can be varied in the axial direction and in the circumferential direction. Since the security ring can be displaced upwards in the axial direction, it is pulled upwards when the threaded part is unscrewed, as a result of which the first and second retaining strips can be shortened and can be better adapted to the open position. As a result of the security ring rotating together when the threaded part is rotated, the first and second retaining strips experience only an axial force and are pulled upwards when the threaded part is unscrewed.

A first and a second recess for accommodating the first and second retaining strips are, expediently, provided on the rim, facing the retaining strip, of the security ring. As a result, the first and second retaining strips can be formed from the security ring in a space-saving manner and without additional material expenditure. For example, the first and second retaining strips can be cut out of the security ring or be formed during the production process of the closure cap.

In a further embodiment of the invention, the first and/or the second ends of the first retaining strip and the third and/or the fourth ends of the second retaining strip are bendable along predefined bending lines. As a result, the first and second retaining strips can each act as a lever with two pivot points. The bending lines also make it possible for the first and second retaining strips not to be bent off or bent at random positions in the open position, but, rather, precisely at the bending lines. As a result, the threaded part is held particularly precisely in the open position by the two retaining strips and is guided exactly into the open position by the two retaining strips.

It has proven to be expedient if an inward-protruding inner cone, e.g., in the form of a sealing cylinder or a sealing ring, is formed on the bottom of the threaded part and is designed to coordinate with the inner wall of the container neck in the closed position in a sealing manner. The closure cap can therefore act as a so-called cone sealer and reliably seals the bottle neck.

In a further embodiment of the invention, the retaining strip has a width between 3 mm and 7 mm, or a width between 4 mm and 5 mm. This dimensioning has the effect that the retaining strip is not unintentionally torn off—particularly when the predetermined breaking webs are torn off. Furthermore, the closure cap does not become too high and can be joined in a sealed manner with standardized container necks having an outer thread.

The invention is also characterized in that the closure cap is designed to coordinate with a standardized container neck having an outer thread and annular projection. The closure cap can therefore be placed onto standardized container necks—in particular, PET beverage bottles. Containers that are joined to the closure cap according to the invention therefore do not have to be specifically adapted to the closure cap.

The closure cap is, expediently, made of a plastic material—such as HDPE (high-density polyethylene) or PP (polypropylene). The closure cap can therefore be produced with standard plastic materials, from which known closure caps having a security ring are also produced.

In a further embodiment of the invention, the threaded part, the security ring, the retaining strip, and the at least one, first and second, predetermined breaking elements are produced in one piece. As a result, the closure cap can be produced in an injection mold without further processing steps being necessary, in order to form the first and second retaining strips. The inner cone may also be produced in one piece together with the other parts of the closure cap.

In a particular embodiment of the invention, the security ring has slots having an upper edge and a lower edge and arranged to be distributed over the circumference, wherein the upper edge is formed by a circular-arc-shaped section of the security ring and the lower edge is formed by a wall section inclined inwards in the radial direction, and the lower edge of each slot forms the projections, as a result of which engagement means for form-fitting engagement with the annular projection are formed. Since the engagement means in the form of the inward-inclined wall sections are not present on the entire circumference of the security ring, and slots whose formation reduces the material usage even further are also present, the material requirement for plastic can be significantly reduced by up to 5%. In addition, the wall section is immovable inwards in the radial direction, as a result of which the security ring is held on the annular projection and cannot be pulled over it until the security ring is stretched along its circumference. The security ring is securely held on the annular projection by the wall sections such that the predetermined breaking elements safely tear before the holding of the wall sections is overcome. However, the wall sections are flexible or movable outwards in the radial direction. As a result, the wall sections can be demolded from the injection mold or the injection-molding tool with little exertion of force. For the same reason, the application force for pressing the container closure is significantly reduced in comparison to the prior art. Expansion of the security ring, which can lead to permanent damage to the retaining element, is largely prevented during demolding and pressing.

A further aspect of the invention relates to a container having a container body, a container neck adjoining the container body, an outer thread formed on the container neck, and a closure cap in accordance with the above description.

In a particular embodiment of the invention, a shoulder is formed on the container neck, which shoulder is formed below the security ring or is formed by the security ring, and the length of the first and second retaining strips is dimensioned in such a way that the threaded part can be lifted out of a closing position after unscrewing from the container neck and can be positioned below the shoulder in an open position, wherein the threaded part is held in the open position on the first and second retaining strips, rests with the open rim at least partially on the container body, and rests against the shoulder. With the aid of the retaining strips, the threaded part is pulled into the transition between the shoulder and the container body in the direction of the container neck, as a result of which a holder for the threaded part is created at the transition. By resting on the shoulder and the container body, the threaded part no longer has any freedom of movement and is therefore held in a particularly stable and wobble-free manner in this open position.

Expediently, the shoulder is a support ring that is formed at the transition from the container neck to the container body. Such a support ring is, in any case, present in a plastic bottle—in particular, a bottle made of PET—for technical production reasons. It is, therefore, particularly practical to use this support ring as a stop for the threaded part. If there is no support ring on the container, it is also possible to form a shoulder on the container neck with a length in the circumferential direction, which length enables the first cylindrical shell of the threaded part to be supported on the shoulder. It is also conceivable for the security ring to be used as a shoulder on which the first cylindrical shell can be supported.

In a further embodiment of the invention, at least one, first depression in the radial direction is provided on the support ring, as a result of which a first holding side having a first corner and a second holding side having a second corner are formed on the support ring, wherein the first and second corners are present at the transition from the first and second holding sides to the open rim of the support ring. By providing the depression, the shell of the threaded part can rest on the support ring at two points when it is pulled by the first and second retaining strips in the open position onto the support ring or clamped thereto. The shell rests with the rim of the support ring at a first point on a first corner of the first holding side. At a second point, the shell rests with the rim of the support ring on a second corner of the second holding side. As a result, the threaded part is held in a stable and wobble-free manner in the open position on the container. If several first depressions are provided, they can serve to guide the retaining strips or to hold them in a defined position in the open position of the threaded part. This improves the stability of the threaded part in the open position even further.

In a further embodiment of the invention, the at least one, first depression is V-shaped or U-shaped. The V or U shape can be produced with little effort and ensures that the open rim of the threaded part rests stably at two points, viz., the first and the second corners. The angular size of the first and second corners in a V-shaped or U-shaped depression is particularly advantageous for reliably holding the threaded part. The first depression may have a depth up to the shoulder of the support ring on the container neck.

In a further embodiment, a plurality of second depressions is provided on the support ring, and these second depressions are arranged symmetrically with respect to a plane of symmetry together with the first and second retaining strips, wherein the plane of symmetry runs through the axis of rotation of the threaded part. The second depressions may be hook-shaped. As a result of their hook-shaped design, the second depressions are particularly suitable for affixing the retaining strips when the threaded part is in the open position. The retaining strips can hook into the second depressions. The position of the possible open positions is clearly predetermined by the symmetrical arrangement with respect to the plane of symmetry.

In another embodiment of the invention, the length of the first and second retaining strips is dimensioned in such a way that the threaded part can be lifted out of a closing position after unscrewing from the container neck and can be positioned next to the container neck in an open position, and is held in the open position on the first and second retaining strips. As already explained above, due to their defined length and their defined position on the security ring and the threaded part, the first and second retaining strips enable an articulation function or a lever function, as a result of which the threaded part can be translationally transferred to a defined open position and is held in this open position on the container neck.

In a further embodiment of the invention, the first and second retaining strips are elastically tensioned in the open position of the threaded part, as a result of which the threaded part in the open position is pulled onto the container neck or the shoulder. As already stated above, the elastic pretensioning of the retaining strips holds the threaded part in a wobble-free and stable manner on the container neck or the shoulder. Due to the elastic expansion of the retaining strips in the open position, the threaded part can also be transferred several times into the open position and can, consequently, be screwed several times onto the container neck.

Expediently, the axis of rotation of the threaded part and the axis of rotation of the container neck are substantially parallel in the open position of the threaded part. As a result, in the open position, the threaded part is in a position in which it does not protrude beyond the container neck and also does not protrude into the pouring opening. The threaded part therefore does not interfere with the use of the container, even though it is held captively thereon.

It has proven to be advantageous if the length of the first and second retaining strips is dimensioned in such a way that the axial orientation of the threaded part in the open position and in the closing position is substantially identical. After unscrewing from the container neck, the threaded part can therefore be transferred into the open position by a translational, forcibly-guided movement.

It has proven to be advantageous if the closure cap can be pressed onto the bottle neck. After its filling, the container can therefore be closed by the closure cap fully automatically and, accordingly, quickly and reliably.

BRIEF DESCRIPTIONS OF THE DRAWINGS

Figure 2:
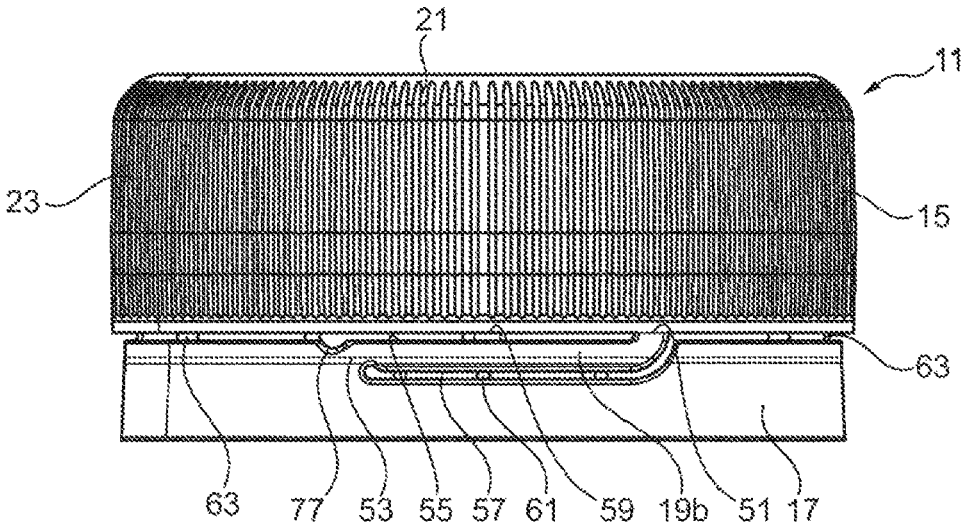
Figure 3:
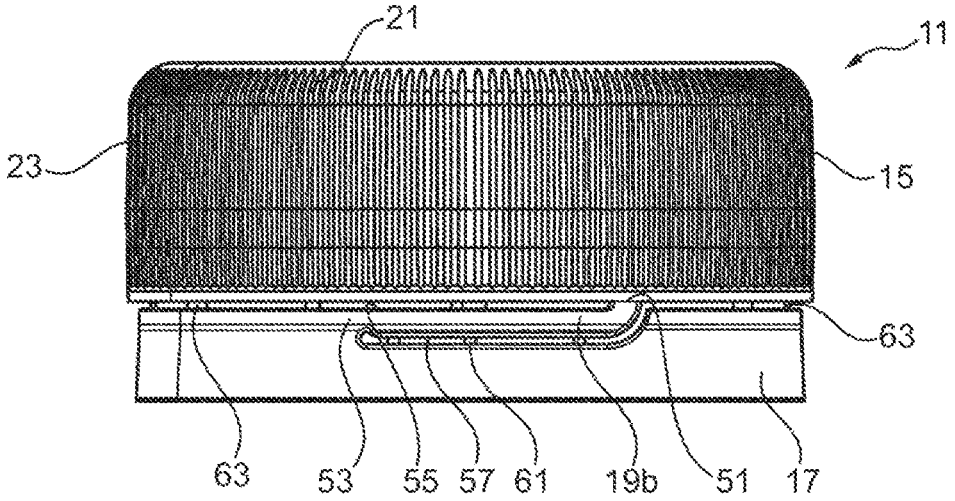
Figure 4:
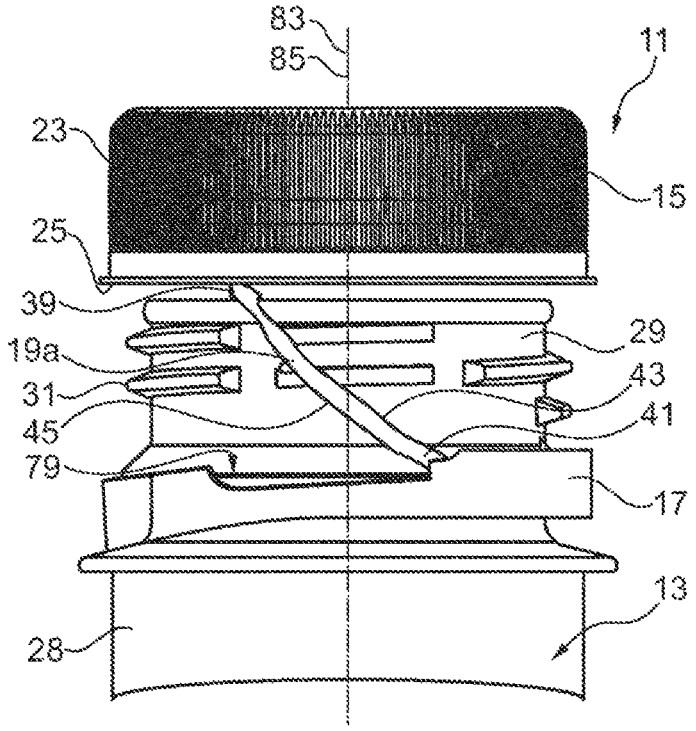
Figure 5:
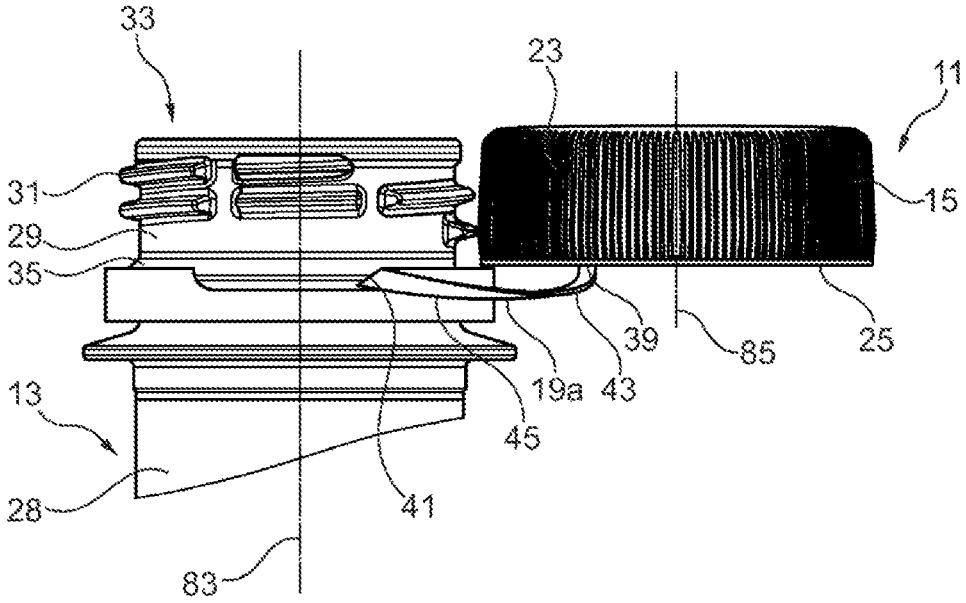
Figure 6:
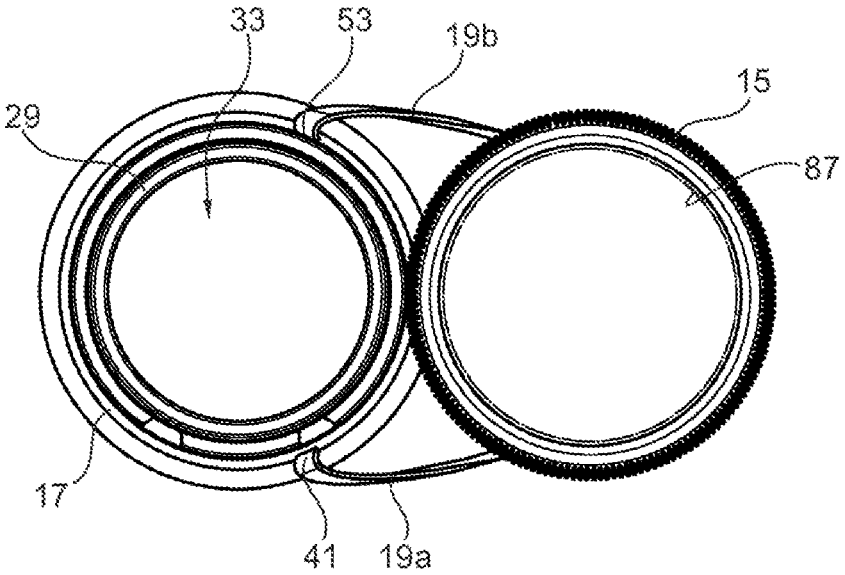
Figure 7:
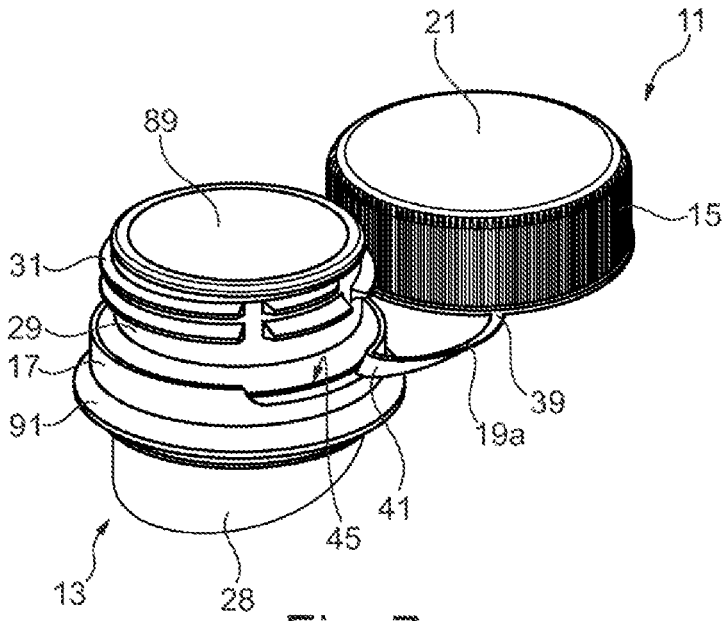
Figure 8:
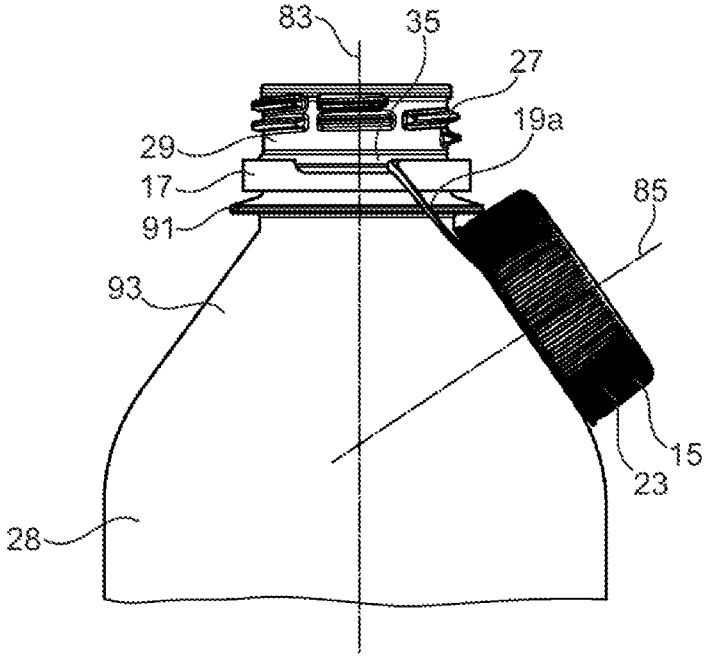
Figure 9:
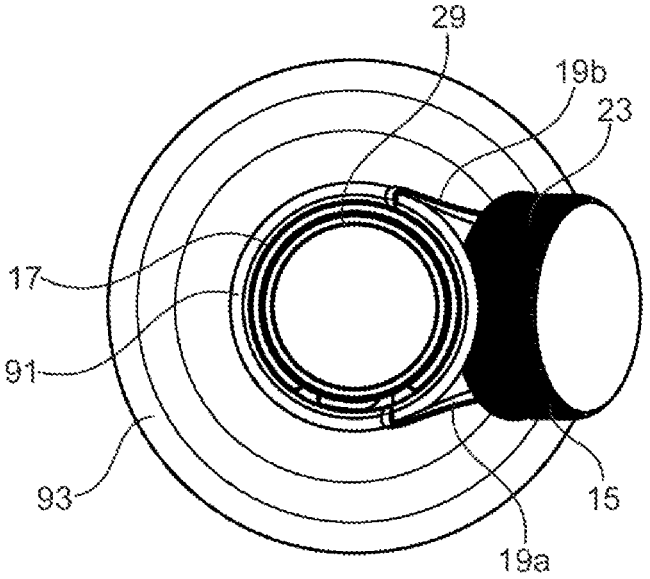
Figure 10:
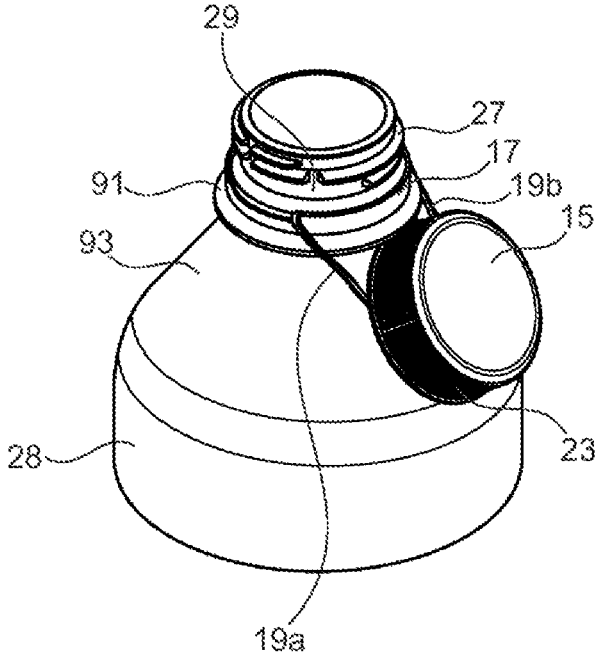
Figure 11:
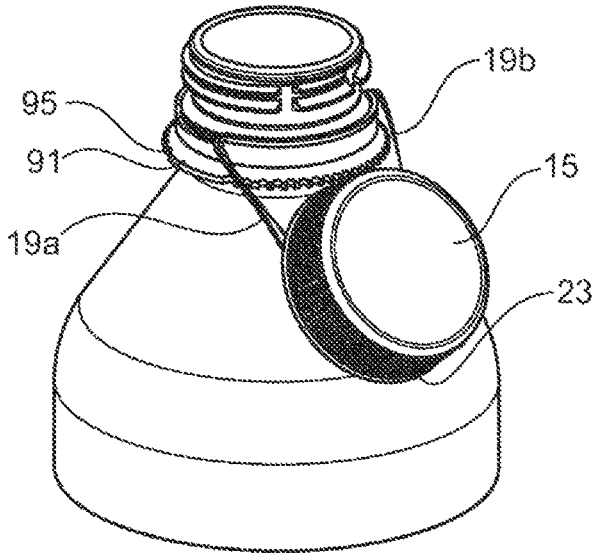
Figure 12:
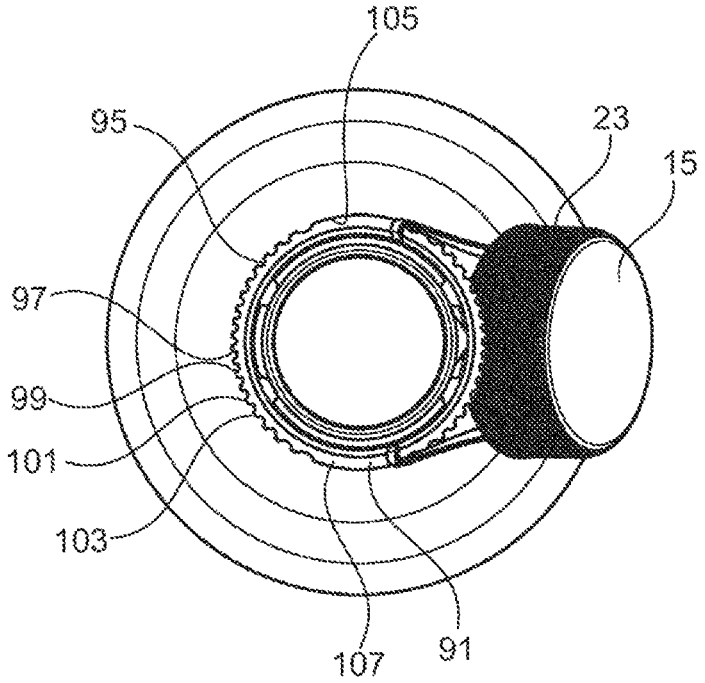
Figure 13:
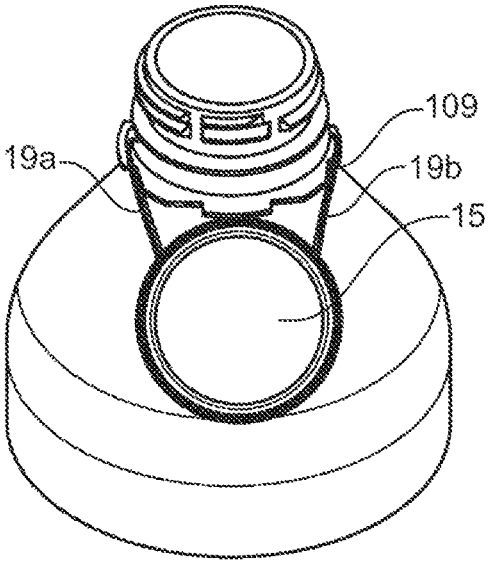
Figure 14:
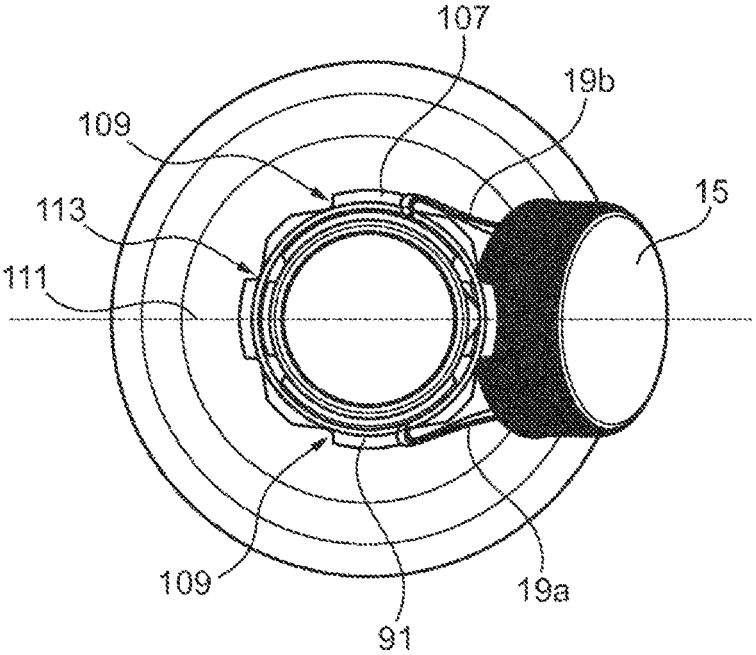
Figure 15:
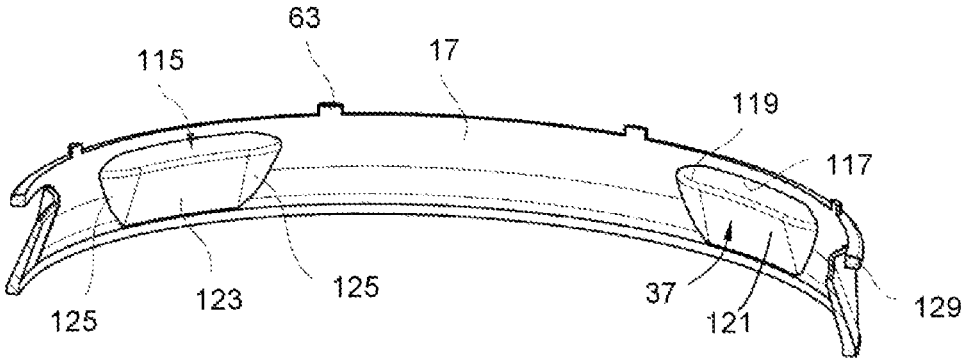

Further advantages and features become apparent from the following description of several exemplary embodiments of the invention, with reference to the schematic drawings. Shown, in a representation not true to scale, are:

FIG. 1: an isometric view of a closure cap obliquely from below in a first embodiment;

FIG. 2: a side view of the closure cap of FIG. 1;

FIG. 3: a side view of the closure cap in a second embodiment;

FIG. 4: a side view of the closure cap, wherein the closure cap is unscrewed from a container neck;

FIG. 5: a side view of the closure cap, wherein the closure cap is in an open position and is arranged next to the container neck, and the closure cap is designed in accordance with the second embodiment;

FIG. 6: a plan view of the closure cap of FIG. 5;

FIG. 7: an isometric view of the closure cap of FIG. 5;

FIG. 8: a side view of the closure cap, wherein the closure cap is in an open position and is arranged below the container neck, and the closure cap is designed in accordance with the second embodiment;

FIG. 9: a plan view of the closure cap of FIG. 8;

FIG. 10: an isometric view of the closure cap of FIG. 8;

FIG. 11: an isometric view of a closure cap and of the container in a further embodiment;

FIG. 12: a plan view of the embodiment of FIG. 11;

FIG. 13: an isometric view of a closure cap and of the container in a further embodiment;

FIG. 14: a plan view of the embodiment of FIG. 13;

FIG. 15: a detailed view of the security ring in a further embodiment; and

Figure 16:
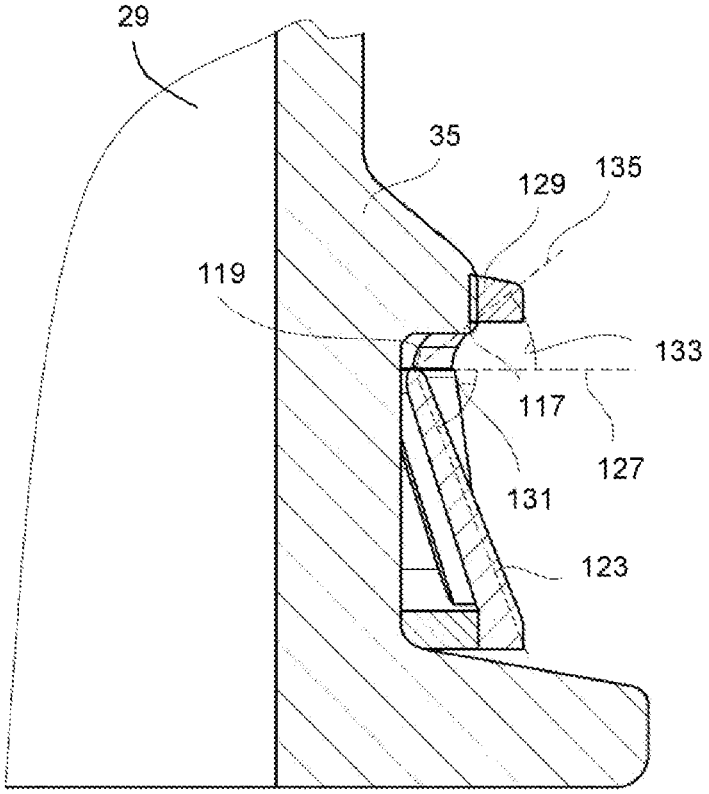

FIG. 16: a sectional view of the security ring of FIG. 15 with visualized inclination angles.

DETAILED DESCRIPTION OF THE INVENTION

FIGS. 1 through 10 show a closure cap, which is denoted as a whole by reference sign 11. The closure cap 11 is captively held on a container 13—in particular, on a bottle 13. The container 13 is indicated in FIGS. 4 through 10. The closure cap 11 comprises a cylindrical threaded part 15, a security ring 17, and a first and a second retaining strip 19*a*, 19*b*.

The threaded part 15 comprises a bottom 21 and a first cylindrical shell 23 having an open rim 25. An inner thread 27 is formed on the inside of the shell 23. The container 13 comprises a container body 28 and a container neck 29 adjoining the container body 28. The container neck 29 is designed as a second cylindrical shell. An outer thread 31 is formed on the container neck 29 and coordinates with the inner thread 27. As a result, the threaded part 15 can be screwed onto and off the container neck 29. The closure cap 11 closes the pouring opening 33, which is provided within the container neck 29.

The security ring 17 is held in a form fit on the container neck 13. For this purpose, an annular projection 35 is formed on the outside of the container neck 29 and can be engaged from below by projections 37 formed on the inside of the security ring 17. The security ring 17 is rotatable in relation to the container neck 29.

The first retaining strip 19*a* has a first end 39 and a second end 41. The first end 39 is securely connected to the open rim 25. The second end 41 is securely connected to the security ring 17. As a result, the closure cap 11 is captively held on the container 13. Furthermore, the first retaining strip 19 has a first rim 43 and a second rim 45. The first rim 43 is connected to the open rim 25 by at least one, first, predetermined breaking web 47, and the second rim 45 is releasably connected to the security ring 17 by at least one, second, predetermined breaking web 49.

The second retaining strip 19*b* has a third end 51 and a fourth end 53. The third end 51 is securely connected to the open rim 25. The fourth end 53 is securely connected to the security ring 17. As a result, the closure cap 11 is additionally captively held on the container 13. Furthermore, the second retaining strip 19*b* has a third rim 55 and a fourth rim 57. The third rim 55 is connected to the open rim 25 by at least one, third, predetermined breaking web 59, and the second rim 45 is releasably connected to the security ring 17 by at least one, fourth, predetermined breaking web 61.

In addition, the security ring 17 is held at the open rim 25 by a plurality of security webs 63. The security webs are arranged at uniform intervals on the security ring 17. It goes without saying that the regions occupied by the first and second retaining strips 19*a*, 19*b* on the security ring 17 are free of security webs 63.

The first and second retaining strips 19*a*, 19*b* have a width between 4 mm and 5 mm so that they are sufficiently stable.

Since the closure cap 11 is rotationally symmetrical, it has a center point 65. The center point 65 lies in the imaginary plane between the open rim 25 and the security ring 17. The first end 39 and the third end 51 enclose a first opening angle 67 of at least 110 degrees and at most 170 degrees, or at least 117 and at most 135 degrees, with respect to the center point 65 as apex. The second end 41 and the fourth end 53 enclose a second opening angle 69 of at least 110 degrees and at most 170 degrees, or at least 117 and at most 135 degrees, with respect to the center point 65 as apex.

The first end 39 and the second end 43 enclose a third opening angle 71 of at least 40 degrees and at most 70 degrees, or at least 45 and at most 63 degrees, with respect to the center point of the closure cap as apex. The third end 51 and the fourth end 53 enclose a fourth opening angle 73 of at least 40 degrees and at most 70 degrees, or at least 45 and at most 63 degrees, with respect to the center point 65 as apex. It goes without saying that the sum of the first, second, third, and fourth opening angles 67, 69, 71, 73 must be 360 degrees. By selecting the first, second, third, and fourth opening angles, it is possible for the first and second retaining strips 19*a*, 19*b* to have a specific length, which enables the functions of the closure cap described below.

Expediently, the third and fourth opening angles 71, 73 are of equal size, which is equivalent to the first and second retaining strips 19*a*, 19*b* being of equal length. The first and second retaining strips 19*a*, 19*b* are carved out of the security ring 17 at an offset of 180 degrees.

According to the embodiment of FIGS. 1 and 2, a first or a second narrowing 75, 77 of the cross-section of the first or the second retaining strip 19*a*, 19*b* is provided at the second or the fourth end 41, 53. The second or the fourth end 41, 53 can act as an articulation as a result of the first and second narrowings 75, 77.

In the embodiment according to FIGS. 3 and 5 through 7, the cross-section of the first and second retaining strips (19*a*, 19*b*) is constant along the length of the first or second retaining strip (19*a*, 19*b*). As a result, the first and second retaining strips (19*a*, 19*b*) can be constantly stretched.

A first and a second recess 79, 81 are provided on the security ring 17. The first and the second retaining strips 19*a*, 19*b* are accommodated in the first or the second recess 79, 81. This makes it possible to machine the first and second retaining strips 19*a*, 19*b* directly out of the security ring 17—for example, by cutting out of the security ring.

If the closure cap 11 is pressed onto the container neck 29, the pouring opening 33 is closed by the closure cap 11, and the closure cap 11 is in a closing position. When the threaded part 15 is unscrewed from the container neck 29, the first, second, third, and fourth predetermined breaking webs 47, 49, 59, 61 and the security webs 63 break. The security ring 17 rotates along with the threaded part 15. During unscrewing, the first and second retaining strips 19*a*, 19*b* can straighten. The second and fourth ends 41, 53 act as an articulation as a result of the first and second narrowings 75, 77. The first and third ends 39, 51 can also be bent, e.g., bent outwards, because the translational movement of the threaded part 15 is thereby simplified and can take place in a more defined manner.

By selecting the third and fourth opening angles 71, 73, the first and second retaining strips 19*a*, 19*b* have a length which enables the threaded part 15 to be moved further after unscrewing from the container neck 29. If the container 13 is perpendicular, the threaded part 15 can first be moved linearly in the horizontal direction in the direction of the first and third ends 41, 53. When the pouring opening 33 is completely released from the threaded part 15, the threaded part 15 can be moved linearly along the container neck 29 in parallel to the axis of rotation 83 of the container neck 29. The length of the first and second retaining strips 19*a*, 19*b* and the optional articulation function of the first and third ends 41, 53 are adapted in such a way that the threaded part 15 is held on the container neck 29 in an open position (FIGS. 5 through 7). The axis of rotation 83 of the container neck and the axis of rotation 85 of the threaded part 15 are oriented to be substantially in parallel in the open position. In the open position, the threaded part 15 is captively held on the container 13 and is affixed to the container neck 29 in such a way that it does not protrude into the pouring opening 33 when liquid is poured out of the container 13. The first and second retaining strips 19*a*, 19*b* enable the threaded part 15 to be transferred, after being unscrewed from the container neck 29, in a forcibly-guided translational movement into the open position. Due to the forced guidance, only one open position exists, and not several. The length and cross-section of the first or the second retaining strip 19*a*, 19*b* are dimensioned in such a way that the first and second retaining strips 19*a*, 19*b* are elastically tensioned in the open position of the threaded part 15. As a result, the threaded part 15 in the open position is pulled onto the container neck 29 and is held thereon in a wobble-free manner. The elastic pretensioning of the first and second retaining strips 19*a*, 19*b* also enables the threaded part to be transferred several times from the open position into the closing position, and vice versa. As a result, the container neck 29 can be opened and closed several times, and after opening, the threaded part 15 is held in the open position in a stable and wobble-free manner each time.

FIGS. 8 through 10 show a further embodiment of how the threaded part 15 can be arranged on the container body 28 in the open position. A shoulder 91, which is formed below the security ring 17 or is formed by the security ring 17 itself, is formed on the container neck 29. The shoulder is formed by a support ring 91 that is located at the transition from the container neck 29 to the container body 28. The threaded part 15 is held in the open position on the first and second retaining strips 19*a*, 19*b*. FIGS. 8 through 10 show the container body 28 with a container shoulder 93. The container shoulder 93 represents the transition from the container neck 29 to the cylindrical part of the container body 28. The retaining strips 19*a*, 19*b* are dimensioned in such a way that the open rim 25 can be pulled over the support ring 91 into the open position. In the open position, the threaded part 15 rests with the open rim 25 on the surface of the container shoulder 93. The first cylindrical shell 23 rests on the support ring 91. The retaining strips 19*a*, 19*b* are slightly tensioned in the open position. As a result, the threaded part 15 is pulled to the support ring 91 and is clamped below the support ring 91. The support ring 91 prevents the threaded part 15 from tilting upwards due to the pulling of the retaining strips 19*a*, 19*b*. Rather, the support ring 91 causes the open rim 25 to be pressed against the container shoulder 93. As a result, the threaded part 15 is held particularly stably in the open position according to FIGS. 8 through 10. It is also conceivable for the first cylindrical shell 23 to rest against the security ring 17 if there is no support ring. In this case, the security ring 17 acts as a shoulder for the threaded part 15.

As FIG. 8 shows, the axis of rotation of the container neck 83 and the axis of rotation 85 of the threaded part enclose an acute angle due to the container shoulder 93. The greater the angle, which may be at most 90 degrees, between the two axes of rotation 83, 85, the greater the tensile force on the container shoulder 93. The smaller the angle between the two axes of rotation 83, 85, the greater the tensile force on the support ring 91.

FIGS. 11 and 12 show the support ring 91 with a plurality of first depressions 95 arranged next to one another. The first depression 95 is V-shaped or U-shaped. As a result, a first and a second holding side 97, 99 are present at the rims of the depression. A first corner 101 is formed at the transition from the first holding side 97 to the open rim 105 of the support ring 91. A second corner 103 is formed at the transition from the second holding side 99 to the open rim 105 of the support ring 91.

The depression 95 enables the threaded part 15 to be held particularly stably on the support ring 91 in the embodiment shown in FIGS. 8 through 10. The shell 23 of the threaded part 15 rests not only with one point on the support ring 91 (see FIG. 8), but is pulled by the retaining strips 19*a*, 19*b* at one point each on the first and second holding sides 97, 99. These points are formed by the first and second corners 101, 103. This "2-point support" additionally stabilizes the threaded part 15 in the open position. The first depressions 95 can additionally be used for the first and second retaining strips 19*a*, 19*b* to be accommodated therein, if the threaded part 15 is in the open position. The retaining strips 19*a*, 19*b* are thereby held or guided. The first depressions 95 contribute to the retaining strips 19*a*, 19*b* being in a unique position in the open position and not being able to slip. As a result, the threaded part 15 is held in its open position even more stably.

The first depressions 95 may be formed circumferentially at equal intervals on the support ring 91. As FIG. 12 shows, the first depressions 95 can also be provided in two, symmetrically-arranged subregions separated from one another by two separating webs 107. As a result, a first and a second region in which the threaded part 15 can assume its open position are predetermined.

FIGS. 13 and 14 show an embodiment in which second depressions 109 are provided on the support ring 91. The second depressions are hook-shaped, so that the first and second retaining strips 19*a*, 19*b* can hook into the second depressions 109. The hook-shaped depressions 109 enable improved guidance of the retaining strips 19*a*, 19*b* on the support ring 91. The second depressions 109 may be arranged in two subregions on the support ring 91. As already described above, the two subregions can be separated from one another by separating webs 107 in order to predetermine two unique regions for the open position of the threaded part 15. The second depressions 109 can be arranged symmetrically with respect to a plane of symmetry 111. The first and second retaining strips 19*a*, 19*b* are also, expediently, arranged symmetrically with respect to the plane of symmetry 111. The plane of symmetry 11 runs through the axis of rotation 85 of the threaded part 15. Indentations 113, which serve to reduce weight, can also be provided on the support ring 91.

In FIGS. 13 and 14, no first depressions 95 are shown, and the first cylindrical shell 23 rests on the open rim 105 as a result. It is of course possible to provide first depressions 95 for more stably holding the threaded part 15 in the open position, in addition to the second depressions 109.

An inward-protruding inner cone 87 (FIG. 6), e.g., in the form of a sealing cylinder or a sealing ring, is formed on the bottom 21 of the threaded part 15. The inner cone 87 is designed to coordinate in a sealing manner with the inner wall 89 of the container neck 29 in the closing position. The closure cap 11 can therefore act as a so-called cone sealer and reliably seals the container neck 29.

In accordance with the following description of FIGS. 15 and 16, the projections 37 may, in a further embodiment, be formed. This embodiment of the projections 37 is the content of the Swiss patent applications with application numbers 01467/19 and 01695/19, the priorities of which were claimed, and the disclosure contents of which are hereby incorporated into the present patent application. Slots 115 are provided on the security ring in a manner distributed over the circumference of the security ring 17. The slots 115 each have an upper edge 117 and a lower edge 119. The upper edge 117 is formed by a circular-arc-shaped section of the security ring 17. The lower edge 119 corresponds to the free rim of a wall section 121 inclined inwards in the radial direction. Due to the inner inclination of the wall section 121, the lower edge 119 has a smaller radius than the security ring 17 and as a result can bear against an abutment (annular projection 35) of the container neck 29 when the threaded part 15 is unscrewed from the container neck 29. The abutment is realized by the annular projection 35, which is formed below the outer thread 31 on the container neck 29. When the threaded part 15 is unscrewed, the lower edge 119 engages in a form fit on the projection 35, as a result of which the security ring 17 is reliably held on the annular projection 35 even under high axial forces.

Each wall section 121 has a first subsection 123 and two second subsections 125. The first subsection 123 represents an inward-folded shell section and is designed to be flat. The second subsections 125 adjoin the inward-facing sides of the first subsection 123 and connect the latter to the security ring 17. The second subsections 125 can be curved or flat and face one another obliquely inwards. The lower edge 119 of the slot 115 corresponds to the free rims of the first subsection 123 and of the second subsections 125, and lies in a plane 127, which is shown in FIG. 16. The plane 127 is oriented to be perpendicular to the axis of rotation 85 of the container neck 29. These described design features of the wall section 121 have the advantage that the wall section 121 can rest with the entire lower edge 119 on the annular projection 35 and does not yield upwards in the event of an axial tensile force. As a result, the security ring 17 is held non-releasably on the projection 35 or can be removed from the projection 35 only by being destroyed. A movement of the first subsection 123 inwards in the radial direction is prevented by providing the second subsections 125. However, a movement of the first subsection 123 outwards in the radial direction is possible. This movement is flexible and, after being pressed radially outwards, the wall section 121 returns to its inward-inclined base position. This has the further advantage that the security ring 17 can be easily demolded and can be pressed together with the threaded part 15 with little force onto the container neck 29. As a result of the flexibility of the wall section 121, the demolding from an injection mold and the pressing onto the container neck 29 can take place without the risk of damaging the wall section 121.

The inclined wall sections 121 have a wall thickness that, in comparison to the remaining security ring 17, is reduced. FIG. 16 shows that the region of the lower edge 119 has the smallest wall thickness. As a result, the above-described flexibility of the wall section 121 radially outwards is further improved. The wall thickness of the wall section 121 increases linearly downwards, starting from the lower edge 119.

FIGS. 15 and 16 show the security ring 17 without the threaded part 15. FIGS. 15 and 16 clearly show that an annular bead 119 on which the upper edges 117 rest is formed above the slots 115 on the security ring 17.

FIG. 16 shows a first and second inclination angle 131, 133. The first inclination angle 131 indicates the inclination of the first subsection 123 with respect to the plane of the lower edge 119. The first inclination angle 131 has a size of between 60 and 80 degrees, or between 65 and 75 degrees. The greater the first inclination angle 131, the better the stability of the wall sections 121 with respect to vertical force effects or axial tensile forces caused by the unscrewing of the threaded part 15. However, the first inclination angle 131 may not become too large, since the projection 35 can otherwise not be sufficiently engaged from below.

The second inclination angle 133 indicates the inclination of the slot 115 with respect to the plane of the lower edge 119. The connecting line 135, which represents the inclination of the slot 115, is a connection of the upper edge 117 to the lower edge 119 in a plane spanned by the axis of rotation 85 and the connecting line 135. The second inclination angle 133 is enclosed by the connecting line 135 and the plane 127. The second inclination angle 133 has a size of between 30 and 50 degrees, or between 35 and 45 degrees. The greater the second inclination angle 133, the more easily the security ring 17 can be demolded.

The closure cap 11 is made of a plastic. PP and HDPE, among others, can be considered suitable plastics.

The invention claimed is:

1. Closure cap for closing the pouring opening of a container, comprising:

a cylindrical threaded part having an open rim and an inner thread configured to coordinate with an outer thread of a container neck of the container, a security ring configured to be held on a projection formed on the container neck, a plurality of security webs releasably connecting the security ring to the open rim, a first retaining strip having a first and a second end and a first and a second rim, wherein the first end is securely connected to the open rim of the threaded part, the second end is securely connected to the security ring, the first rim is releasably connected to the open rim of the threaded part by at least one, first, predetermined breaking web, and the second rim is releasably connected to the security ring by at least one, second, predetermined breaking web, and a second retaining strip having a third and a fourth end and a third and fourth rim, wherein the third end is securely connected to the open rim of the threaded part, the fourth end is securely connected to the security ring, the third rim is releasably connected to the open rim of the threaded part by at least one, third, predetermined breaking web, and the fourth rim is releasably connected to the security ring by at least one, fourth, predetermined breaking web, wherein the first and the third ends enclose a first opening angle of at least 110 degrees and at most 140 degrees with respect to the center point of the closure cap as apex, and the second and the fourth ends enclose a second opening angle of at least 110 degrees and at most 135 degrees with respect to a center point of the closure cap as apex.

2. Closure cap according to claim 1, wherein the first and second ends enclose a third opening angle of at least 40 degrees and at most 70 degrees with respect to the center point of the closure cap as apex.

3. Closure cap according to claim 1, wherein the third and the fourth ends enclose a fourth opening angle of at least 40 degrees and at most 70 degrees with respect to the center point of the closure cap as apex.

4. Closure cap according to claim 3, wherein the third and the fourth opening angles are of equal size, as a result of which the first and the second retaining strips are of equal length.

5. Closure cap according to claim 1, wherein a cross-section of the first and second retaining strips is constant along a length of the first or second retaining strip.

6. Closure cap according to claim 1, wherein a first or a second narrowing of a cross-section of the first or the second retaining strip is provided at the second or the fourth end, as a result of which the second or the fourth end can act as an articulation.

7. Closure cap according to claim 1, wherein the plurality of security webs arranged at uniform intervals along the open rim.

8. Closure cap according to claim 1, wherein the first, second, third, and fourth predetermined breaking webs are arranged at uniform intervals along the first and second or the third and fourth rims.

9. Closure cap according to claim 1, wherein a position of the security ring in relation to the projection of the container neck can be varied in an axial direction and in a circumferential direction.

10. Closure cap according to claim 1, wherein a rim of the security ring defines a first recess and a second recess each facing and configured to accommodate a respective one of the first and second retaining strips.

11. Closure cap according to claim 1, wherein the first and/or the second ends of the first retaining strip and the third and/or the fourth ends of the second retaining strip are configured to be bendable along predefined bending lines.

12. Closure cap according to claim 1, further comprising an inward-protruding inner cone in the form of a sealing cylinder or a sealing ring, is formed on a bottom of the threaded part and is configured to coordinate in a sealing manner with an inner wall of the container neck in a closed position.

13. Closure cap according to claim 1, wherein the first and second retaining strips each have a width between 3 mm and 7 mm.

14. Closure cap according to claim 1, wherein the closure cap is configured to coordinate with a PET beverage bottle neck having an outer thread and an annular projection.

15. Closure cap according to claim 1, wherein the closure cap is made of a plastic material.

16. Closure cap according to claim 1, wherein the threaded part, the security ring, the first and second retaining strips, the plurality of security webs, and the at least first, second, third, and fourth predetermined breaking webs are formed in one piece.

17. Closure cap according to claim 1, wherein the security ring defines a plurality of slots each having an upper edge and a lower edge and arranged to be distributed over a circumference, wherein the upper edge is formed by a circular-arc-shaped section of the security ring, and the lower edge is formed by a wall section inclined inwards in a radial direction, and the lower edges of the plurality of slots forms a plurality of projections configured to engage in a form-fitting manner with the projection.

18. Container, comprising:

a container body, a container neck adjoining the container body, an outer thread formed on the container neck, and a closure cap for closing a pouring opening provided within the container neck, the closure cap having a cylindrical threaded part having an open rim and an inner thread configured to coordinate with an outer thread of a container neck of the container, a security ring configured to be held on a projection formed on the container neck, a plurality of security webs releasably connecting the security ring to the open rim, a first retaining strip having a first and a second end and a first and a second rim, wherein the first end is securely connected to the open rim of the threaded part, the second end is securely connected to the security ring, the first rim is releasably connected to the open rim of the threaded part by at least one, first, predetermined breaking web, and the second rim is releasably connected to the security ring by at least one, second, predetermined breaking web, a second retaining strip having a third and a fourth end and a third and fourth rim, wherein the third end is securely connected to the open rim of the threaded part, the fourth end is securely connected to the security ring, the third rim is releasably connected to the open rim of the threaded part by at least one, third, predetermined breaking web, and the fourth rim is releasably connected to the security ring by at least one, fourth, predetermined breaking web, wherein, the first and the third ends enclose a first opening angle of at least 110 degrees and at most 140 degrees, with respect to the center point of the closure cap as apex, and the second and the fourth ends enclose a second opening angle of at least 110 degrees and at most 135 degrees with respect to a center point of the closure cap as apex.

19. Container according to claim 18, further comprising a shoulder on the container neck, the shoulder formed below the security ring or formed by the security ring, and respective lengths of the first and second retaining strips being such that the threaded part can be lifted out of a closing position after unscrewing from the container neck and can be positioned below the shoulder in an open position, wherein the threaded part is held in the open position on the first and second retaining strips, rests at least partially with the open rim on the container body, and rests against the shoulder.

20. Container according to claim 19, wherein the shoulder is a support ring that is formed at a transition from the container neck to the container body.

21. Container according to claim 20, further comprising at least one, first depression in a radial direction on the support ring, as a result of which a first holding side having a first corner and a second holding side having a second corner are formed on the support ring, wherein the first and second corners are present at the transition from the first and second holding sides to the open rim of the support ring.

22. Container according to claim 21, further comprising a plurality of second depressions on the support ring, the plurality of second depressions together with the first and second retaining strips are arranged symmetrically with respect to a plane of symmetry, wherein the plane of symmetry runs through an axis of rotation of the threaded part.

23. Container according to claim 22, wherein the plurality of second depressions are each hook-shaped.

24. Container according to claim 18, wherein a respective length of the first and second retaining strips is dimensioned in such a way that the threaded part can be lifted out of a closing position after unscrewing from the container neck and can be positioned next to the container neck in an open position, and is held in the open position on the first and second retaining strips.

25. Container according to claim 18, wherein the first and second retaining strips are elastically tensioned in an open position of the threaded part, as a result of which the threaded part is pulled onto the container neck or the shoulder in the open position.

26. Container according to claim 25, wherein an axis of rotation of the threaded part and an axis of rotation of the container neck are substantially parallel in the open position of the threaded part.

27. Container according to claim 24, wherein the length of the first and second retaining strips is dimensioned in such a way that an axial orientation of the threaded part in the open position and in the closing position is substantially identical.

28. Container according to claim 18, wherein the closure cap is configured to be pressed onto the container neck.

* * * * *